US007077037B2

(12) United States Patent
Shevela et al.

(10) Patent No.: US 7,077,037 B2
(45) Date of Patent: Jul. 18, 2006

(54) APPARATUS AND METHOD FOR REMOVING A BOLT FROM AN ASSEMBLY

(75) Inventors: Michael Shevela, Harrison Township, MI (US); Richard W. Mills, LaPoret, IN (US)

(73) Assignee: SPX Corporation, Charlotte, NC (US)

( * ) Notice: Subject to any disclaimer, the term of this patent is extended or adjusted under 35 U.S.C. 154(b) by 84 days.

(21) Appl. No.: 10/697,872

(22) Filed: Oct. 31, 2003

(65) Prior Publication Data

US 2005/0092140 A1 May 5, 2005

(51) Int. Cl.
*B25B 23/00* (2006.01)

(52) U.S. Cl. ..... 81/436; 81/121.1

(58) Field of Classification Search ..... 81/437, 81/438, 439, 451, 436, 461, 121.1, 180.1, 81/119, 124.6, 124.4
See application file for complete search history.

(56) References Cited

U.S. PATENT DOCUMENTS

| | | | | |
|---|---|---|---|---|
| 5,101,698 | A * | 4/1992 | Paradiso | 81/451 |
| 5,460,064 | A * | 10/1995 | Zayat, Jr. | 81/185 |
| 5,485,769 | A * | 1/1996 | Olson et al. | 81/177.85 |
| 6,023,999 | A * | 2/2000 | Cho | 81/185 |
| 6,047,620 | A * | 4/2000 | Kozak et al. | 81/441 |
| 6,272,953 | B1 * | 8/2001 | Kant | 81/461 |
| 6,282,998 | B1 * | 9/2001 | Beach | 81/437 |
| 6,928,906 | B1 * | 8/2005 | Marks | 81/185 |
| 2002/0017170 | A1 * | 2/2002 | Amis | 81/121.1 |

* cited by examiner

*Primary Examiner*—Jacob K. Ackun, Jr.
(74) *Attorney, Agent, or Firm*—Baker & Hostetler LLP

(57) ABSTRACT

A method and apparatus for removing a fastener from an assembly in which the fastener is aligned with a concave end of the apparatus. A socket bit holder has a first end and a second end, with the first end being a concave end, and having a socket bit receptacle. The second end has a socket drive receptacle.

30 Claims, 4 Drawing Sheets

APPARATUS AND METHOD FOR REMOVING A BOLT FROM AN ASSEMBLY

FIELD OF THE INVENTION

The present invention relates generally to a method and apparatus for removing a fastener from an assembly. More particularly, the present invention relates to a method and tool for removing a bolt from an automotive seat belt assembly.

BACKGROUND OF THE INVENTION

During disassembly processes, it is sometimes necessary to remove a fastener from a work-piece being disassembled. During this procedure, specialized tools may be employed to loosen the aforementioned fastener from the work-piece being disassembled. One example of such a tool may include a socket wrench.

Examples of known socket wrenches generally have proven valuable, in part, due to their interchangeable sockets that are generally designed to mount upon a driving stub of a socket wrench head. Each socket may further be configured to make a snug sliding fit upon, for instance, a polygonal head of a rotatable threaded fastener such as a bolt or a nut for example. Such sockets may be used with any of several fastener driving tools which include a socket wrench as stated above, or a pneumatic nut driver, or a screwdriver type hand tool which has a shaft with a socket at the end.

Alternatively, the socket may be designed to essentially contain a functional end specialized, for example, for holding and retaining a bit. The bit design may correspond to a mating design, for instance, in a top head of a fastener such as a screw. Once the bit is placed in the mated design of the screw head, a torque can be applied to the bit via the retaining socket bit holder in order to turn the screw head accordingly.

A number of problems may exist, however, in various attempts to remove a fastener, such as a screw, from an assembly using the aforementioned bit held and retained by a socket bit holder. For example, over time, a fastener, such as a bolt, may become rusted within an assembly. In this instance, a greater torque may need to be applied to the bolt head. In an instance where a bit was utilized to turn the bolt head, a greater torque would need to be applied to the bit via the socket bit holder. It may be common, given the additional applied torque needed to turn the bolt head, that the bit breaks. Such an occurrence typically occurs approximately mid-way up the length of the bit during attempts to disassemble the bolt head in this fashion.

Another problem may occur from difficulty in trying to hold the bit square to the bolt as torque is applied to the bit. In order to transfer the greatest amount of torque to the bolt via the bit held and retained by the socket bit holder, it is of some importance to align and maintain alignment throughout the torque process of the bit with respect to the bolt head. Misalignment of the bit relative to the bolt head could cause a loss of torque energy necessary to turn the bolt and, hence, remove it from the assembly. Furthermore, misalignment in the aforementioned manner may cause the bolt to become stripped, either along its threaded portion in the assembly itself or within the mated design of the screw head for receiving the bit held and retained by the socket bit holder.

Additionally, another problem may arise in finding an automatic tool head capable of adapting to the mated design configuration of a fastener head such as one utilized within a bolt head. For instance, in the automobile industry, a torx® bolt having a torx® bolt design in the screw head may commonly be utilized in the attachment and securement of components. Torx® driving systems provide a standard fastener head with a star shaped counterbore in the top face of the fastener that is a drive by a tool having complementary star shaped protruding stub from the tool end. The stub design maybe in the form of removable interchangeable bits.

Torx® driving systems generally allow high torque transmission to the counterbore in the top face of the fastener that is driven by a tool. The tool end of a torx® tool maybe typically include straight vertical sidewalls incorporated into the design of the complementary shaped protruding stub of the tool end. This design works to virtually eliminate a can-out effect of the tool end since little or no end load is required to keep the tool end engaged within the recess of the counterbore in the top face of the fastener.

Additional advantages of torx® driving systems may include reducing tool slippage with respect to the counterbore of a fastener. This would also work to eliminate/reduce damage to both the tool and fastener. An additional advantage may include reduction in wear to the drive bit and, hence, extending the life of the tool. Because torx® driving systems generally facilitate the turning of torx® bolts, reduction of muscle fatigue and/or muscular stress can result during manual assembly/disassembly. This, in part, is due to the design of the torx® driving system which works to achieve maximum engagement between the tool end and the counterbore of the torx® driving system which works to achieve a maximum engagement between the tool end and the counterbore of the torx® bolt. Furthermore, the aforementioned connection is designed to spread the driving forces over a larger contact area to ensure optimal torque transmission for the required applied load.

One such component where Torx® fasteners are used may include attaching seat belt assemblies to a portion or portions of an automobile surface. Whereas a ½" impact wrench for vibratory removal may be readily available, there may not exist a common conversion tool adapter to allow the wrench to couple to the fastener such as the torx® bolt design of the torx® bolt. Hence, the benefits of using an automated tool to remove fasteners such as bolts may not be realized unless a proper adapter is retrofitted to couple the tool to the head of the bolt. Such benefits may be important to realize greater torque values applied to the fastener head and increasing the speed of the disassembly process in general.

Accordingly, it is desirable to provide a method and apparatus that is capable of removing fasteners from an assembly by applying suitable amounts of torque without damaging the apparatus and/or fastener. Additionally, it is desirable to provide a method and apparatus for removing fasteners from an assembly by holding the apparatus square to the fastener in order to maximize any applied torque to the fastener during removal from the assembly. Furthermore, it is desirable to provide a method and apparatus for removing fasteners from an assembly by coupling the fastener to an adapter for an available impact wrench or other retrofitted tools.

SUMMARY OF THE INVENTION

The foregoing needs are met, to a great extent, by the present invention, wherein in one aspect an apparatus for removing fasteners is provided that in some embodiments includes a socket bit holder having a first end and a second end wherein the first end is a concave end. The first end may further comprise a socket bit receptacle. The second end may further comprise a socket drive receptacle.

In accordance with another aspect of the present invention, a method of removing a fastener from an assembly is provided that in some embodiments includes providing a fastener having a bit configuration in a top head of the fastener and inserting a bit into the bit configuration. The method also includes retaining the bit in a socket bit receptacle of a socket bit holder and aligning the top head of the fastener against a concave end of the socket bit holder. The method also includes turning the socket bit holder with the bit inserted into the bit configuration and the top head aligned against the concave end to turn the fastener.

In accordance with yet another aspect of the present invention, a system for removing a fastener having a receptacle from an assembly is provided that in some embodiments includes a means for inserting into an insertion receptacle, a means for retaining the inserting means, and a means for aligning the fastener with the retaining means.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
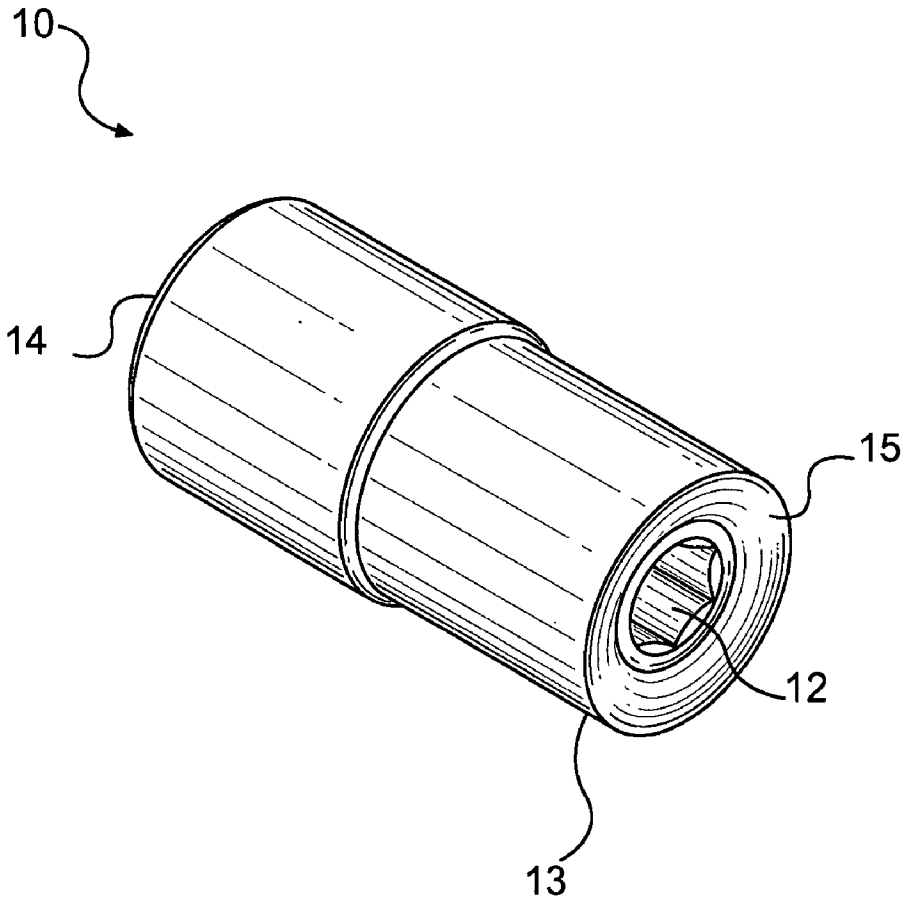
FIG. 1 is a perspective view illustrating a socket bit holder according to a preferred embodiment of the invention.

An embodiment in accordance with the present invention provides a method and apparatus that is capable of removing fasteners from an assembly by applying suitable amounts of torque without damaging the apparatus and/or fastener. An embodiment in accordance with another aspect of the present invention provides a method and apparatus for removing fasteners from an assembly by holding the apparatus square to the fastener in order to efficiently apply torque to the fastener during removal from the assembly. An embodiment in accordance with another aspect of the present invention provides a method and apparatus for removing fasteners from an assembly by coupling the fastener to an adapter for an available impact wrench or other retrofitted tools. The invention will now be described with reference to the drawing figures, in which like reference numerals refer to like parts throughout.

Figure 2:
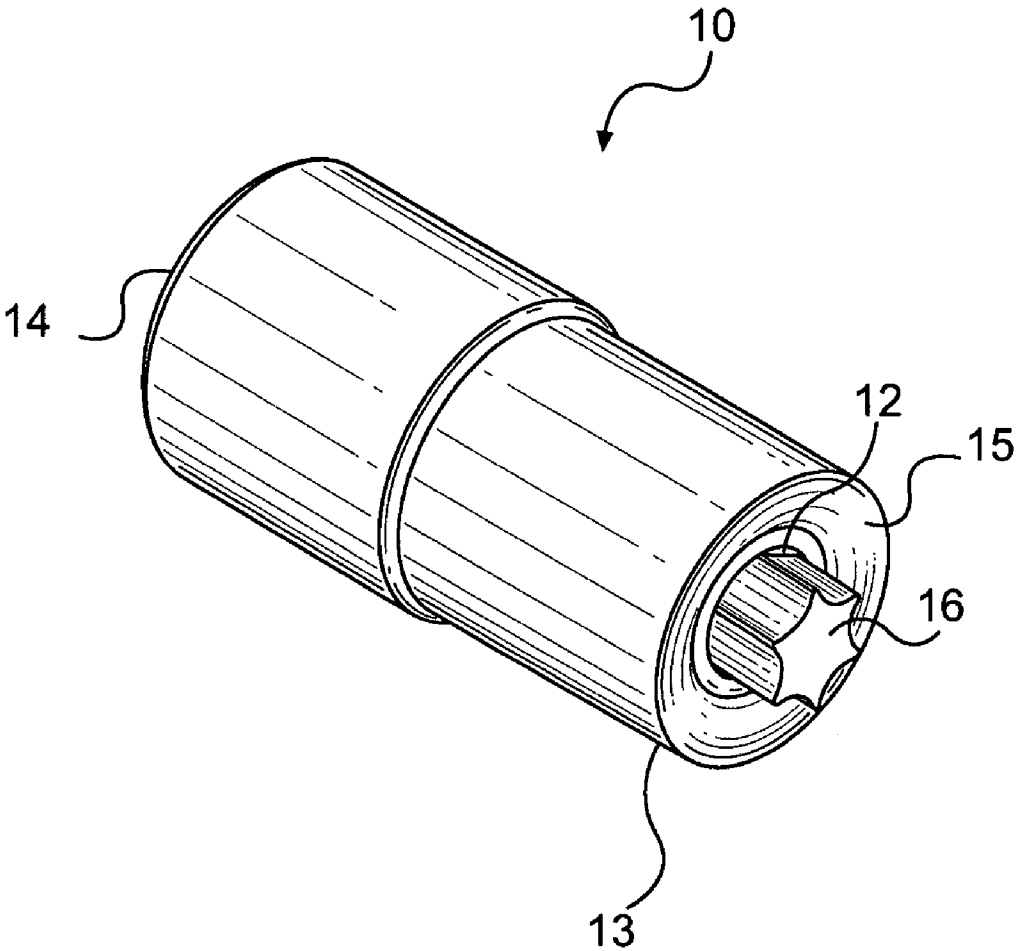
FIG. 2 is a perspective view illustrating a torx® bit inserted within the socket bit receptacle of the socket bit holder shown in FIG. 1.
Figure 3:
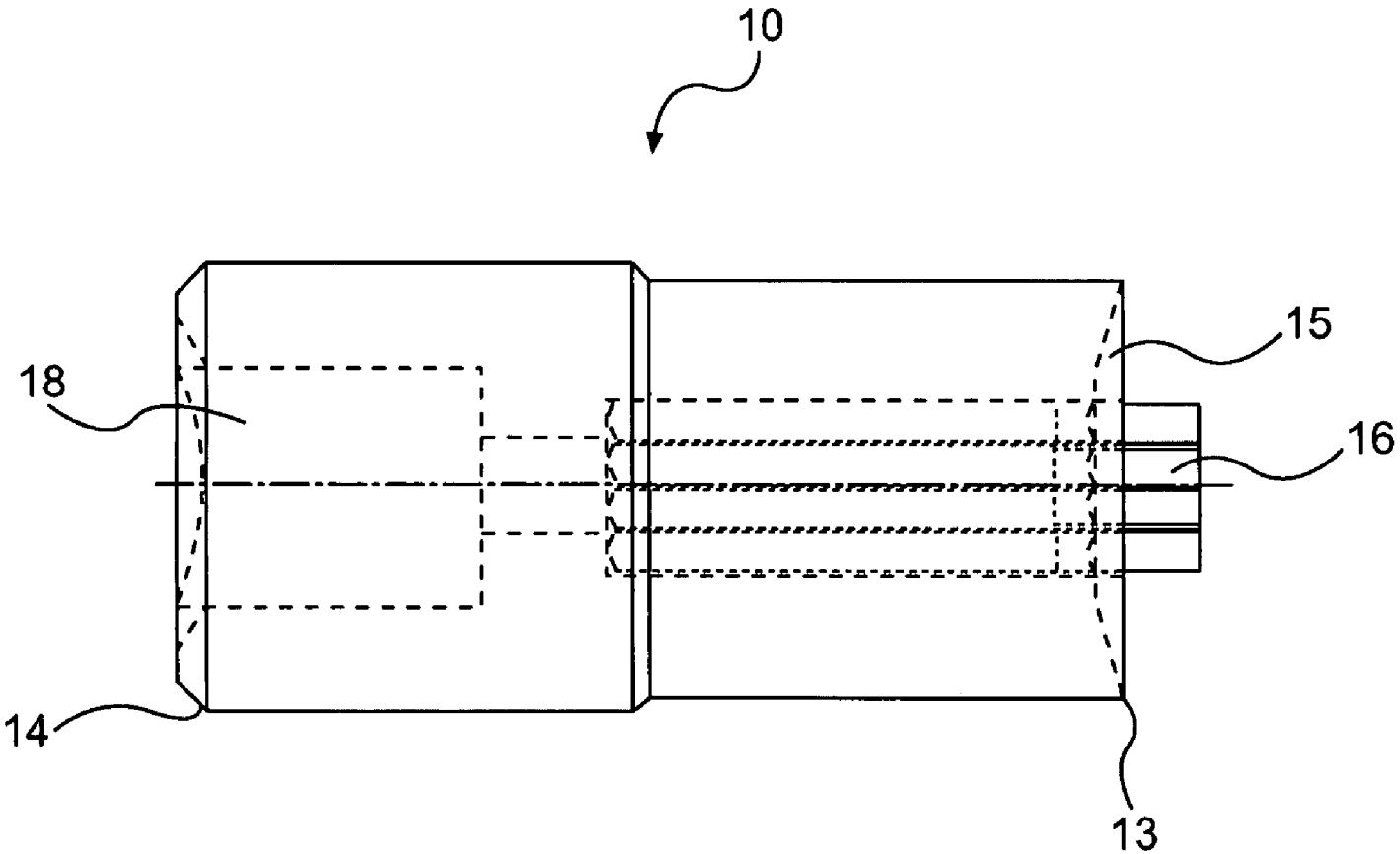
FIG. 3 is a schematic diagram of a side view of the torx® bit inserted with the socket bit receptacle of the socket bit holder shown in FIG. 1.

An embodiment of the present inventive apparatus utilized by the method is illustrated in FIGS. 1–3. FIG. 1 shows a socket bit holder 10 having a first end 13 and a second end 14. A socket bit receptacle 12 is located at the first end 13 of the socket bit holder 10. The socket bit receptacle 12 is preferably configured to receive various drive bit assemblies. The various drive bit assemblies are capable of mating with a plurality of mated designs located in a head of a fastener such as a bolt. The socket bit receptacle is preferably of a hexagonal cross section, but square or octagonal or other splined or keyed designs may be alternatively used.

The first end 13 of the socket bit holder 10 is preferably configured with a concave end configuration 15 which generally extends from an outer diameter of the socket bit holder 10 toward the socket bit receptacle 12. The arrangement of the concave end configuration 15 is designed to urge against the head of a fastener, such as a bolt, in a preferred alignment. Additional discussion of the aforementioned accommodation and alignment will be further discussed below.

FIG. 2 illustrates the socket bit holder 10 in combination with a torx® bit 16 which is received in the socket bit receptacle 12. The torx® bit may be one of any commercially available bits such as a 5/16" hex bit. Although an example of a bit is shown having a hex bit configuration, it will be appreciated that other bit configurations can be utilized in conjunction with the socket bit holder 10, and are preferably selected to mate with the cross section of the bit receptacle 12.

FIG. 3 illustrates a side view diagram of the torx® bit 16 inserted into the socket bit receptacle 12 of the socket bit holder 10. In a preferred embodiment of the invention, a socket drive receptacle 18 is configured on the socket bit holder 10 and is generally located at a second end 14. The socket drive receptacle 18 is designed to receive the drive stub of a wrench head. This may include the drive stub of a wrench head for one of a plurality of commercially available pneumatic and/or impact wrench tools for example. In a preferred embodiment of the invention, the socket drive receptacle 18 is designed with a ½" square drive. While a ½" square drive may be preferred, other designs may be employed as the socket drive receptacle 18 for the socket bit holder 10 which otherwise couples the socket bit holder 10 to the drive stub of a wrench head.

Figure 4:
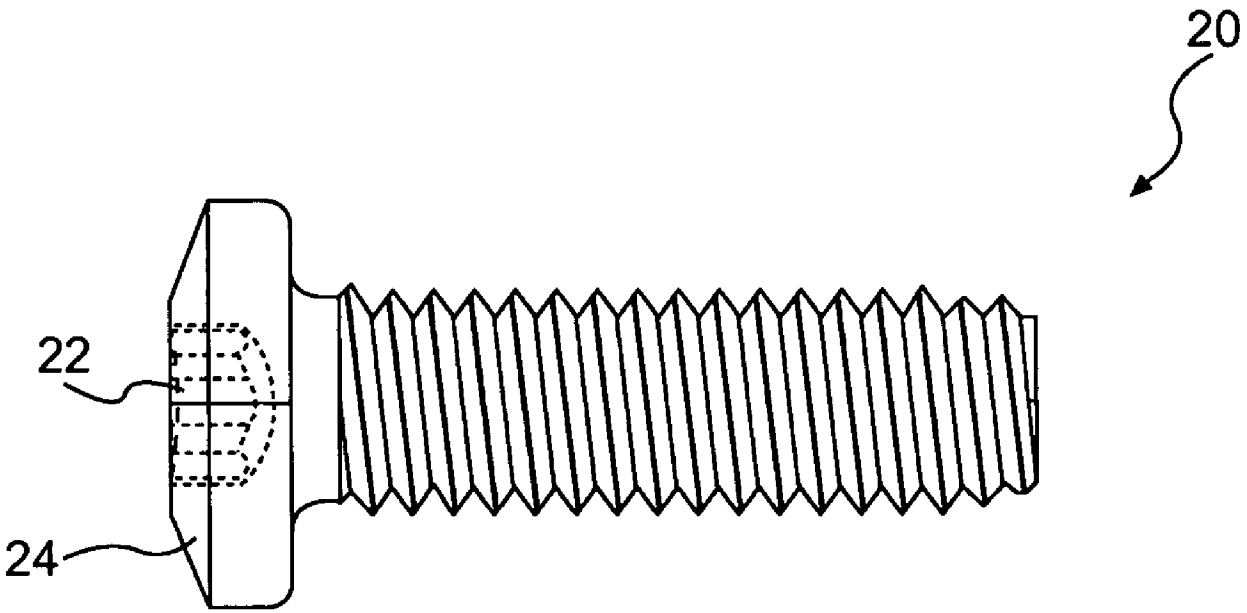
FIG. 4 is a side view of a fastener utilized in an assembly.

In FIG. 4, a torx® bolt fastener 20 is illustrated having a torx® design configuration 22 located in the torx® bolt head 24. By way of example, a torx® bolt fastener 20 is described for illustrative purposes, however, it will be appreciated that another kind of fastener can alternatively be used in conjunction with a corresponding bit 16.

In application, a fastener, such as the torx® bolt fastener 20, may be difficult to turn for any one of many reasons. For instance, sometimes the torx® bolt faster 20 may be located in an awkward position or between objects having little surrounding clearance space. In another instance, it may be possible that the torx® bolt fastener 20 is rusted in place perhaps due to exposure to environmental conditions. It may be the case that a thread sealant was applied during the initial factory installation of the torx® bolt fastener 20 in order to prevent the thread from accidentally unscrewing from the assembly during its operative life. The torx® bolt fastener 20 may also be situated at an angle making removal difficult/awkward.

The apparatus of the preferred embodiment invention may provide an advantage for removing fasteners in the difficult circumstances applied above. As an example, the implementation of preferred embodiments of the apparatus and method for removing fasteners using the apparatus of the present invention is particularly useful in the removal of torx® bolt fasteners 20 from seat belt assemblies.

Preferably, the socket bit holder 10 is designed to retain the torx® bit 16 within the socket bit receptacle 12 such that there is a relatively small distance of protrusion of the torx® bit 16 from the socket bit receptacle 12. Preferably, the distance of protrusion is such that the bit 16 extends approximately fully into the torx® bit when the torx® bit 16 is mated to rest on the head of the torx® bit as explained in more detail below. This arrangement has a tendency to localize any forces along and/or around the torx® bit for transmittal to the mating torx® configuration 22 located on the torx® bolt head 24 in order to facilitate turning the torx® bolt 20 for removal. Hence, when a torque is applied to the torx® bit 16 via the socket bit holder 10, the applied forces will be more localized at the connection point of the torx® bit 16 to the mating torx® configuration 22 located on the torx® bolt head 24. This phenomenon generally allows for the greatest amount of torque to be applied towards turning the torx® bolt 20 for removal from an assembly. By localizing the turning force, counteractive forces (such as rusting effects or sealants) are more likely to be overcome by the higher application of torque when used in the prescribed manner.

The concave end 15 of the bit holder 10 is also designed to facilitate the removal of fasteners such as the torx® bolt 20. When the torx® bit 16 is mated with the torx® configuration 22 of the torx® bolt 20, the beveled top circumferential edge of the torx® bolt head 24 is also generally mated with the concave end 15 of the socket bit holder 10. During operation of the socket bit holder 10 in a preferred embodiment of the invention, the concave end 15 interacts with the beveled top circumferal edge of the torx® bolt head 24 so that the socket bit holder urges the bit holder 10 into generally perpendicular relationship with the bolt head 24 to provide a desirable alignment. This alignment generally at least substantially achieves a squareness between the socket bit holder 10, the torx® bit 16 and the torx® bolt head 24. This is primarily achieved by aligning the center of the torx® head 24 with the concave end 15. In so doing, the surface contact of the torx® bit 16 within the torx® configuration 22 of the torx® bolt head 24 is not only generally maximized, but the connection also serves to help facilitate and retain the alignment process. Thus, when a torque is applied to the socket bit holder 10 to turn the torx® bolt 20 via the torx® bit 16 within the torx® bolt head 24, the concave end 15 urges against the beveled circumferential surface of the torx® bolt head 24 to facilitate at least to some extent the best alignment between components. This, in turn, yields a connection conducive to maximizing the greatest amount of torque to the torx® bolt 20 to facilitate turning and hence, the removal thereof.

Additionally, the socket drive receptacle 18 is useful for attaching the bit holder 10 to a variety of socket wrenches and/or their respective drives and/or socket extensions. This may include, for instance, a ½" square drive. The use of ½" square drives are also utilized, for example, by currently available pneumatic impact wrenches. Although an example of the socket bit holder 10 is shown using a socket drive receptacle 18, it will be appreciated that other receptacles can be used.

Thus, the particulars of the design of the socket bit holder 10 work to facilitate the increased strength of the first end 13. One or all of these features may include the provisions for retaining the bit within the socket bit receptacle 12 such that there is a controlled distance of protrusion of the bit from the end 13 in order to localize applied forces. Another feature may include the concave end 15 for facilitating a preferred alignment of the socket bit holder 10 with respect to the fastener such as the torx® bolt 20. In a preferred embodiment, the socket bit holder also features a socket drive receptacle to allow coupling of a wrench, pneumatic tool, screwdriver or other retrofitted tool. Also, although the socket bit holder 10 is useful to remove torx® bolts 20 in seat belt assemblies, it can also be used to remove other kinds of fasteners in other industries.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for removing fasteners, comprising:

a socket bit holder having a first end and a second end, the first end comprising a socket bit receptacle and a continuous concave surface surrounding the socket bit receptacle, and the second end comprising a socket drive receptacle.

2. The apparatus of claim 1, further comprising a bit inserted into the socket bit receptacle.

3. The apparatus of claim 2, wherein the bit protrudes a predetermined distance from the first end.

4. The apparatus of claim 1, wherein a wrench is connected to the socket drive receptacle.

5. The apparatus of claim 4, wherein the wrench is pneumatic.

6. The apparatus of claim 1, wherein the socket drive receptacle accommodates a ½" square drive.

7. The apparatus of claim 1, wherein the concave surface has a generally annular shape extending substantially from an outer perimeter of the first end to the socket bit receptacle.

8. The apparatus of claim 1, wherein the concave surface generally conforms to a shape of a fastener head.

9. The apparatus of claim 8, wherein the concave surface urges the socket bit holder into a substantially perpendicular relationship with respect to the fastener head.

10. The apparatus of claim 8, wherein the concave surface substantially aligns the first end with the fastener head.

11. The apparatus of claim 1, wherein the socket bit holder further comprises a single solid piece of a material.

12. The apparatus of claim 11, wherein the socket bit receptacle comprises a cavity in the socket bit holder having an opening at the first end.

13. The apparatus of claim 11, wherein the socket bit receptacle further includes a hexagonal cross section.

14. The apparatus of claim 2, wherein the bit has a generally six-pointed star-shaped cross section.

15. The apparatus of claim 14, wherein the cross section is at least in part formed from six concave curve segments spaced equidistantly around and tangent to a geometric circle with a center at a longitudinal axis of the bit.

16. The apparatus of claim 14, wherein the points of the star are truncated.

17. The apparatus of claim 3, wherein the predetermined distance is approximately equal to a depth of a specified fastener head configuration.

18. The apparatus of claim 3, wherein the predetermined distance is less than a depth of a specified fastener head configuration.

19. A system for removing a fastener having an insertion receptacle from an assembly, comprising:

means for inserting into the insertion receptacle;

means for retaining the inserting means such that the inserting means protrudes a predetermined distance from the retaining means;

means for aligning the fastener with the retaining means; and means for receiving a socket drive.

20. The system of claim 19, wherein the means for retaining is a socket bit holder.

21. The system of claim 19, wherein the means for aligning is a continuous concave surface.

22. The system of claim 19, wherein the means for receiving a socket drive comprise a ½" square drive.

23. The system of claim 19, further comprising means for torquing attached to the receiving means.

24. The system of claim 23, wherein the means for torquing is a wrench.

25. The system of claim 24, wherein the wrench is pneumatic.

26. The system of claim 19, wherein the inserting means has a generally six-pointed star-shaped cross section.

27. The system of claim 26, wherein the cross section is at least in part formed from six concave curve segments spaced equidistantly around and tangent to a geometric circle with a center at a longitudinal axis of the bit.

28. The system of claim 19, wherein the aligning means generally conforms to a shape of a specified fastener head and substantially aligns the retaining means with the fastener.

29. The system of claim 19, wherein the predetermined distance is approximately equal to a depth of a specified fastener head configuration.

30. The system of claim 19, wherein the predetermined distance is less than a depth of a specified fastener head configuration.

* * * * *